US005457469A

United States Patent [19]

Diamond et al.

[11] Patent Number: 5,457,469

[45] Date of Patent: Oct. 10, 1995

[54] SYSTEM INCLUDING SPIRAL ANTENNA AND DIPOLE OR MONOPOLE ANTENNA

[75] Inventors: James A. Diamond, Harrison, N.Y.; Maurice Diamond, Sharon, Mass.

[73] Assignee: RDI Electronics, Incorporated, New Rochelle, N.Y.

[21] Appl. No.: 922,261

[22] Filed: Jul. 30, 1992

Related U.S. Application Data

[63] Continuation-in-part of Ser. No. 645,585, Jan. 24, 1991, abandoned.

[51] Int. Cl.[6] ..... H01Q 1/00; H01Q 1/36

[52] U.S. Cl. ..... 343/730; 343/895

[58] Field of Search ..... 343/730, 895, 343/805, 878, 882; H01Q 1/38, 1/36, 1/00

[56] References Cited

U.S. PATENT DOCUMENTS

| | | | |
|---|---|---|---|
| 2,935,746 | 5/1960 | Marston et al. | 343/761 |
| 2,977,594 | 3/1961 | Marston et al. | 343/882 |
| 3,039,099 | 6/1962 | Chait et al. | 343/851 |
| 3,045,240 | 7/1962 | Raynor | 343/793 |
| 3,641,579 | 2/1972 | Voronoff | 343/792.5 |
| 3,681,772 | 8/1972 | Ingerson | 343/895 |
| 3,683,392 | 8/1972 | White | 343/805 |
| 3,820,117 | 6/1974 | Hall et al. | 343/802 |
| 3,925,784 | 12/1975 | Phelan | 343/754 |
| 3,946,392 | 3/1976 | Whitman | 343/830 |
| 3,956,751 | 5/1976 | Herman | 343/895 |
| 4,015,264 | 3/1977 | Koerner | 343/725 |
| 4,032,921 | 6/1977 | Sikina, Jr. et al. | 343/730 |
| 4,114,164 | 9/1978 | Greiser | 343/895 |
| 4,525,720 | 6/1985 | Corzine et al. | 343/895 |
| 4,559,539 | 12/1985 | Markowitz et al. | 343/725 |
| 4,608,572 | 8/1986 | Blakney et al. | 343/792.5 |
| 4,644,366 | 2/1987 | Scholz | 343/895 |
| 4,658,262 | 4/1987 | DuHamel | 343/792.5 |
| 4,725,848 | 2/1988 | Honda | 343/895 |
| 5,119,105 | 6/1992 | Ngai et al. | 343/882 |

FOREIGN PATENT DOCUMENTS

| | | | |
|---|---|---|---|
| 57-83901 | 5/1982 | Japan | H01Q 19/00 |
| 1294831 | 11/1972 | United Kingdom | H01Q 11/08 |

*Primary Examiner*—Donald Hajec
*Assistant Examiner*—Tan Ho
*Attorney, Agent, or Firm*—Kenyon & Kenyon

[57] ABSTRACT

A broadband antenna system includes a frequency-dependent antenna and a frequency-independent antenna rotatably coupled to the frequency-dependent antenna. The antenna system may be arranged such that a dipole or monopole antenna is rotatably coupled to the inner or outer termination points of a spiral antenna, which is, in turn, movably coupled to a base. When the dipole antenna is coupled to the outer termination points of the spiral antenna, the elements of the spiral antenna may be extended.

8 Claims, 9 Drawing Sheets

SYSTEM INCLUDING SPIRAL ANTENNA AND DIPOLE OR MONOPOLE ANTENNA

CROSS REFERENCE TO RELATED APPLICATIONS

This application is a continuation-in-part of U.S. application Ser. No. 645,585, filed Jan. 24, 1991, now abandoned.

FIELD OF THE INVENTION

The present invention relates to an antenna system and in particular to a broadband antenna system.

BACKGROUND OF THE INVENTION

A problem with known antennas that operate in the frequency range of 40 MHz to 860 MHz, the range that includes UHF, VHF and FM reception, is that over at least a portion of this range they are not good receivers.

Typically, commercially available antennas that cover this range are of the frequency-dependent type, which includes, among others, monopole and dipole antennas. The most commonly used frequency-dependent antennas for VHF and FM reception are half-wave dipole antennas, commonly referred to as rabbit-ear antennas.

Frequency-dependent antennas operate over a limited frequency range. The antenna output and other parameters vary significantly as a function of frequency, so as to make it necessary to adjust the antenna in some manner at each frequency of interest to cover a broader range of frequencies. For example, a half-wave dipole antenna may be fully extended to receive low-frequency transmission (e.g., channel 2 television), and may be progressively shortened to receive higher frequencies/channels. Additionally, the antenna may need rotation about its vertical axis to ensure that the beam peak points in the general direction of signal transmission.

Consequently, frequency-dependent antennas need frequent adjustment as the frequency intended to be received varies. Users often ignore this need, which contributes to sub-optimal performance. Prior attempts to eliminate the need for frequent adjustment have resulted in an abundance of tuning requirements that have complicated operation to the degree where it is not only inconvenient to a user, but also nearly impossible to actually reach an optimum level of performance.

An additional problem with frequency-dependent antennas is that the gain is relatively low, on the order of 1 DB. The gain is often improved (i.e. signal reception is strengthened) through active signal amplification at the antenna output, but at the expense of an increase in system noise, which always occurs when pre-amplification is employed. This creates an additional need for DC power. Such an active system (i.e., one requiring DC power to operate) is more costly, more complicated, and more likely to break down.

Frequency-independent antennas, by contrast, require little or no adjustment throughout the entire range over which they operate because the antenna output and other parameters do not vary significantly as a function of frequency over the specified bandwidth of the antenna. Such antennas are especially attractive for broadband applications in instances where active signal amplification is not required. However, their limitation is that they must be very large to receive low-frequency transmissions, severely limiting their usefulness in a home environment. A relatively small stand-alone frequency-independent antenna is not capable of effectively receiving signals in the low-frequency range.

A spiral antenna, for instance, is a wellknown type of frequency-independent, broadband antenna that requires no tuning over a wide range of frequencies. Spiral antennas are typically used in military applications which, by their very nature, do not allow for frequent adjustment of antenna structures. For example, spiral antennas are often mounted in the belly of aircrafts for use in situations in which the direction of signal transmission, the particular signal frequency, and the time of signal receipt are not known, and the position of the antenna is not, and indeed cannot be, adjusted. As a result, the received signals contain a large amount of noise. Through the use of sophisticated and expensive electronic processing units, a large portion of the noise can be removed, and, thus, the direction and frequency of the signals can be determined.

An Archimedes spiral antenna comprises at least one radiating element formed into a spiral in accordance with a predetermined mathematical formula. If the antenna comprises two or more radiating elements, the radiating elements are typically interleaved.

The rate of growth of a conductor is the rate at which the radiating elements spiral outwardly. The number of conductors and their rate of growth have a direct relationship to the frequency range to be covered by the antenna. In general, a signal is received at a portion of the spiral antenna having a circumference equal to the wavelength of the signal. The low-frequency limit of a spiral antenna is defined as the frequency of a signal with a wavelength equal to the largest circumference of the spiral antenna. Therefore, to receive the long wavelengths of low-frequency transmission, the spiral must be quite large. For example, a spiral antenna used to receive channel 2 television transmissions would have to have a diameter of approximately 6 feet, and a circumference of approximately 19 feet. For obvious reasons, this size factor severely limits the usefulness of spiral antennas in a home environment. Moreover, UHF/VHF/FM antennas are typically inexpensive structures that cannot afford the use of sophisticated signal processing equipment.

A need therefore exists for a relatively inexpensive antenna that covers a broad range of frequencies with sufficient signal reception throughout the broad frequency range while having a streamline construction and providing ease of use.

SUMMARY OF THE INVENTION

The present invention provides an antenna system that covers a broad range of frequencies and provides strong signal reception throughout the frequency range. In particular, the antenna system of the present invention comprises a frequency-dependent antenna and a frequency-independent antenna rotatably (for example, pivotally) coupled to the frequency-dependent antenna, to provide an antenna system that covers a broad range of frequencies while providing a signal strength greater than that of either a frequency-dependent or frequency-independent antenna alone. The antenna system of the present invention is capable of covering low frequencies while maintaining a relatively small size.

The antenna system of the present invention requires little if any active signal amplification. As a result, the antenna system is easy to construct and use. Furthermore, because of the use of a frequency-independent antenna, the antenna system requires only infrequent adjustment over the frequency range of 40 MHz to 860 MHz. The ability to adjust the frequency-dependent antenna and/or the frequency-independent antenna allows the position of the two antennas relative to one another and/or relative to a base to change, in order to improve signal reception. Consequently, the use of sophisticated and expensive signal processing equipment is unnecessary.

Moreover, the antenna system of the present invention is superior to a stand-alone frequency-dependent or frequency-independent antenna in that the antenna system is capable of linear polarization at any angle. Linear polarization is the receiving of only one of two orthogonal, directional components of a signal's electric field (the direction of the electric field being normal to the direction of the signal).

In an embodiment of the present invention, the frequency-independent antenna comprises a two-element Archimedes spiral antenna with two outer and two inner termination points, and the frequency-dependent antenna comprises a half-wave dipole antenna, although any frequency-independent and frequency-dependent antennas may be used. The dipole antenna may be coupled to either the outer or inner termination points of the spiral antenna such that the position of the dipole antenna elements relative to the spiral antenna can be adjusted, for example by rotating and/or controlling the length of (i.e., shortening or extending) the dipole elements.

The spiral antenna of this embodiment is basically circular in shape and spiralling outwardly. However, spiral antennas of any shape including, by way of example, elliptical, square, rectangular, and diamond-shaped spiral antennas may be used. Indeed, a spiral antenna having yet another configuration is described below. The spiral antenna comprises two interleaved radiating elements although the principles of the present invention are applicable to any number of radiating elements. In an embodiment of the present invention, the frequency-dependent antenna is coupled to either the outer or the inner termination points of the spiral antenna, while two transmission lines are coupled to the opposite termination points.

When the frequency-dependent antenna is coupled to the outer termination points of the spiral antenna, each element of the spiral antenna may be extended some additional distance beyond the termination points. For example, if the antenna is circular-shaped, the elements may extend circumferentially beyond the termination points. These spiral extensions serve to enhance reception and broadbanding. In still other embodiments, a monopole antenna may be used as the frequency-dependent antenna.

In yet another embodiment of the present invention, a two-element spiral antenna contained within a housing is coupled to a base such that the spiral antenna is free to rotate and tilt with respect to the base. A dipole antenna may be rotatably coupled to the inner or outer termination points of the spiral antenna. Such adjustment capabilities provide for improved signal reception.

DETAILED DESCRIPTION OF THE INVENTION

Figure 1:
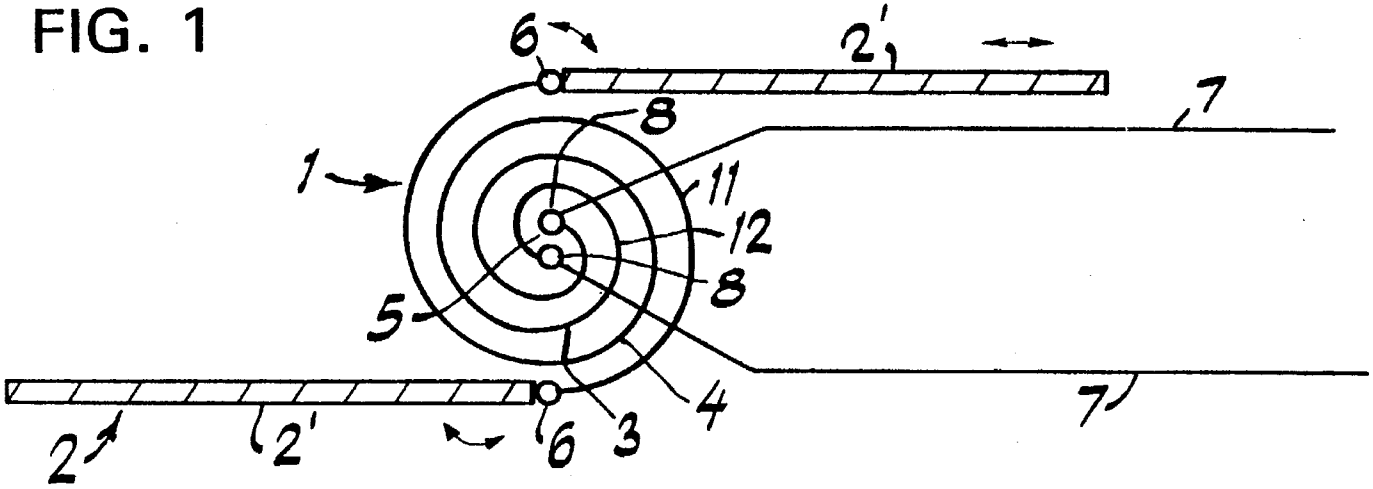
FIG. 1 shows a top-plan view of a first embodiment of an antenna system of the present invention.

Referring now to FIG. 1, there is shown a first embodiment of an antenna system of the present invention. The antenna system comprises an Archimedes spiral antenna 1 and a half-wave dipole antenna 2.

The spiral antenna 1 comprises two interleaved radiating elements 3 and 4. The radiating elements 3 and 4 may be constructed of any suitable conductive material including, by way of example, patterns etched on a PC board, wound wire, and sprayed conductive material on an insulating background.

The spiral antenna 1 is basically circular-shaped, although the principles of the present invention are applicable to spiral antennas of any shape, as will be illustrated with reference to FIG. 6.

The radiating elements 3 and 4 originate at a central portion 5 and spiral outwardly in a spiral path in a common plane about a common central axis to a selected radius. The radiating elements may spiral outwardly according to the formula r=ko, where r=radius from central portion, k=constant, and o=angle of radius. The low frequency limit of the antenna system may be that of the Archimedes spiral antenna 1, which is the frequency of a signal with a wavelength equal to the largest circumference of the spiral antenna 1.

Each of the two elements 2' of the half-wave dipole antenna 2 is coupled to the spiral antenna 1 at a corresponding one of the two outer termination points 6 of the spiral antenna 1. As is the case with all of the embodiments of the system according to the present invention described below, each of the elements 2' of the dipole antenna 2 is coupled to the spiral antenna 1 such that the element 2' is free to rotate (i.e., move) about the point 6 at which it is coupled to the spiral antenna 1, as shown by the curved bidirectional arrow at each termination point 6 in FIG. 1. In other words, each of the elements 2' is rotatably (for example, pivotally) coupled to the spiral antenna 1 such that the position of the element 2' is adjustable with respect to the position of the spiral antenna 1. This allows the element 2' to point in the general direction of signal transmission, and thus provides improved reception of signals. The actual coupling member at termination point 6 used to support this rotational movement of dipole element 2' will be explained below with reference to FIG. 7.

Moreover, each of the dipole elements 2' may be extendable such that the element 2' can be shortened or lengthened depending upon the desired frequency of the signal to be received, as shown by the straight bidirectional arrow at each element 2' in FIG. 1. This extendibility feature also provides improved signal reception.

Each of two transmission lines 7 is coupled to a receiver and to the spiral antenna 1 at a corresponding one of the two inner termination points 8 of the spiral antenna 1.

The antenna may, for example, comprise a flat, two-wire Archimedes spiral antenna with an 8" diameter coupled to a half-wave dipole antenna, commonly referred to as a rabbit-ear antenna, with approximately 37" long elements. The resulting antenna system covers a wide range of frequencies, i.e., the entire spectrum between 50 MHz and 5,000 MHz, and yet may be relatively small and require only infrequent adjustment. The antenna system yields consistently strong signal reception for UHF, VHF and FM frequencies, i.e., stronger than that of a stand-alone frequency-dependent or frequency-independent antenna. Furthermore, little if any active signal amplification is required and, as a result, the antenna system is easy to construct and use.

It is believed that coupling a dipole antenna 2 to the termination points of a spiral antenna 1 to form an antenna system extends the low-frequency capability of the spiral antenna 1 for linear polarization without adding appreciably to the volume. The direction of a signal's electric field vector defines the direction of polarization. Because the dipole elements 2' are coupled to the spiral antenna 1 so as to provide for 360° of rotation of the dipole elements 2', linear polarization at any angle can be achieved because the dipole elements 2' can be positioned to any angle. The spiral antenna 1 adds electrical length to the dipole antenna 2, and acts as a broadband transmission line matching section, i.e., the spiral antenna 1 enhances receiving capability by producing a maximum signal at the transmission lines.

It is believed that at the VHF frequencies, channels 2 through 13, signal reception takes place partially at the dipole elements 2', and partially at the outer portion 11 of the spiral antenna 1 (i.e., the portion of the radiating elements 3 and 4 close to the outer termination points 6 of the spiral antenna 1). The inner portion 12 of the spiral antenna 1 (i.e., the portion of the radiating elements 3 and 4 close to the inner termination points 8 of the spiral antenna 1) acts mainly as a transmission line matching section.

With respect to the UHF frequencies, channels 14 through 82, it is believed that reception of lower frequency signals takes place mainly at the outer portion 11 of the spiral antenna 1. Reception of higher frequency signals takes place mainly at the inner portion 12 of the spiral antenna 1.

It is believed that the beam width (i.e., the number of degrees between the points where the power of a signal is one-half its maximum value) is approximately 80° throughout the whole UHF frequency range. Received signals are cigar-shaped (elliptical) at right angles to the plane of the spiral antenna 1. The signals are circularly polarized in one direction on one side of the plane, and circularly polarized in the opposite direction on the other side of the plane (circular polarization is the receiving of two orthogonal, directional components of a signal's electric field).

Figure 2:
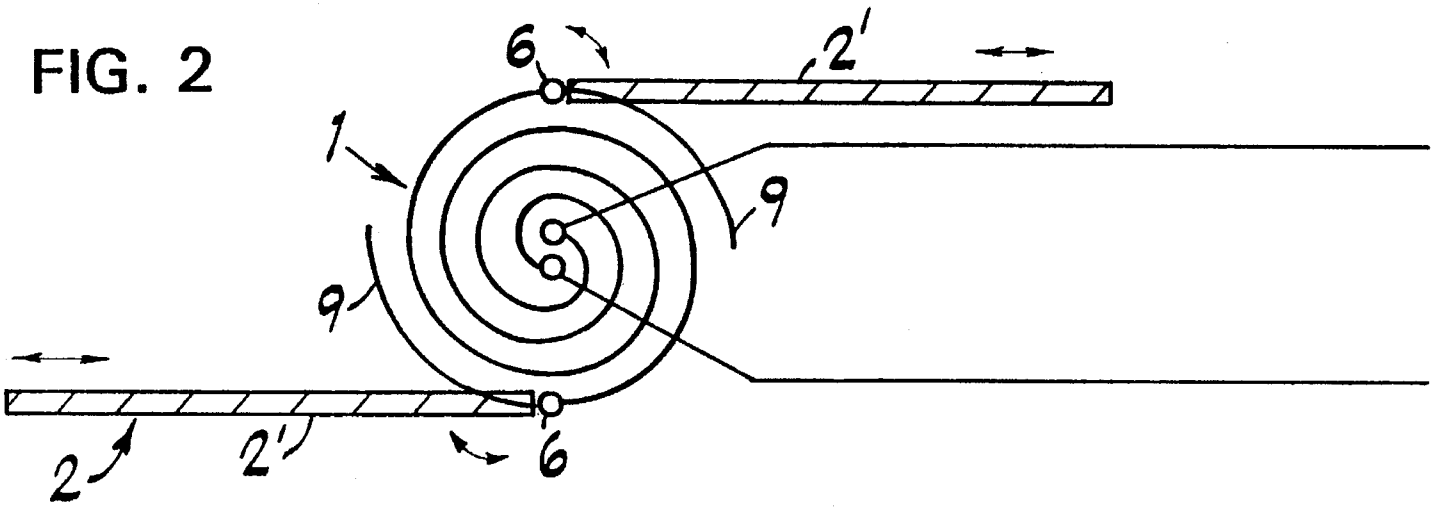
FIG. 2 shows a top-plan view of a second embodiment of an antenna system of the present invention.

Referring now to FIG. 2, there is shown a second embodiment of the present invention. This antenna system is similar to the antenna system illustrated in FIG. 1, except that it further includes two spiral extensions 9, each of which continue beyond one of the two outer termination points 6 of the spiral antenna 1. The spiral extensions 9 extend approximately one-quarter of a turn beyond the outer termination points 6 to which the elements 2' of the dipole antenna 2 are connected. The spiral extensions 9 are similar in construction and method of winding to the rest of the spiral antenna 1. The spiral extensions 9 serve to enhance reception and broadbanding.

Figure 3:
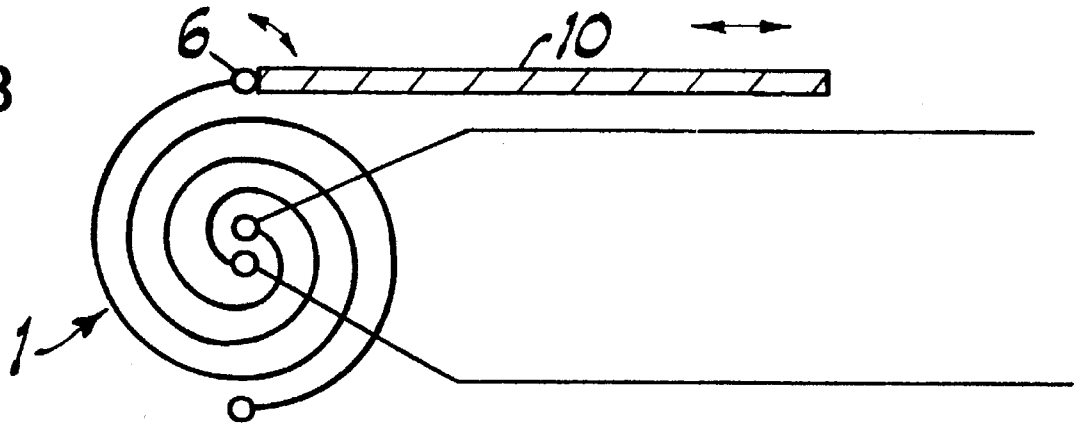
FIG. 3 shows a top-plan view of a third embodiment of an antenna system of the present invention.

Referring now to FIG. 3, there is shown a third embodiment of the present invention. This antenna system is similar to the antenna system illustrated in FIG. 1, except that the dipole antenna is replaced by a monopole antenna 10, which is rotatably coupled to the spiral antenna 1 at one of the outer termination points 6 of the spiral antenna 1. Similar to the elements of the dipole antenna, the length of the monopole antenna 10 is adjustable so that the antenna can be shortened or lengthened in order to improve signal reception.

The spiral antenna 1 acts as a broadband transmission line matching section and adds electrical length to the monopole antenna 10. Thus the spiral antenna 1 serves to minimize the negative effects typically associated with the removal of one of the elements of a stand-alone dipole antenna to create a monopole antenna.

Figure 4:
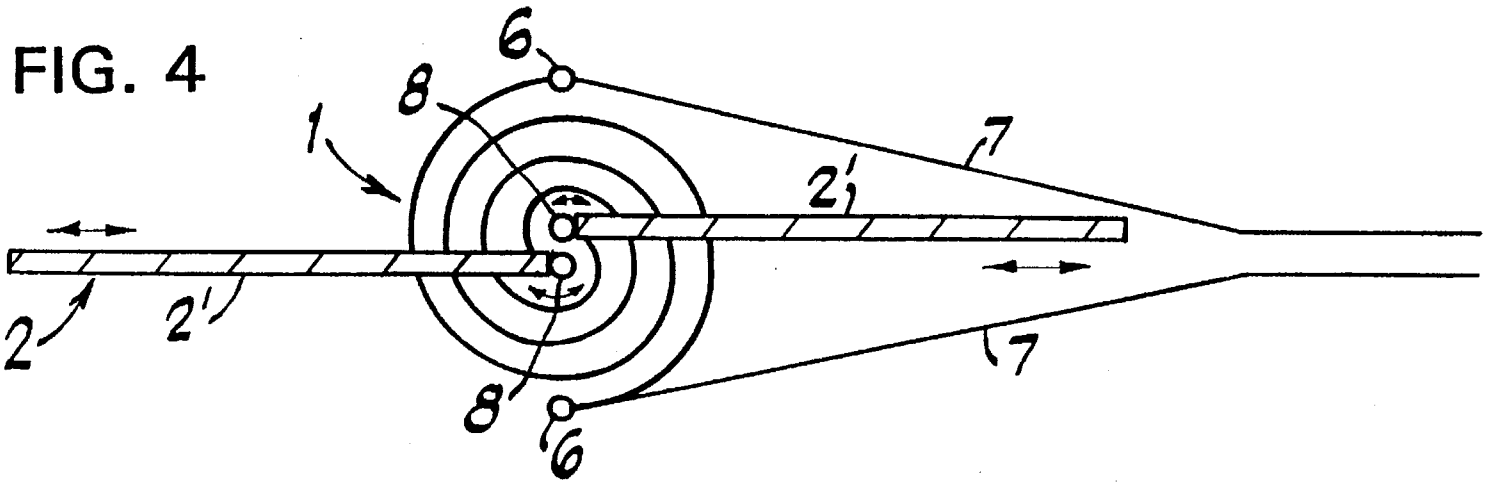
FIG. 4 shows a top-plan view of a fourth embodiment of an antenna system of the present invention.

Referring now to FIG. 4, there is shown a fourth embodiment of the present invention. This antenna system is also similar to the antenna system illustrated in FIG. 1, except that each of the two elements 2' of the dipole antenna 2 is connected to the spiral antenna 1 at one of the two inner termination points 8, rather than outer termination points 6 of the spiral antenna 1, while each of the two transmission lines 7 is connected to the spiral antenna 1 at one of the two outer termination points 6, rather than inner termination points 8 of the spiral antenna 1.

The performance of this antenna system is similar to the antenna system illustrated in FIG. 1, except that the direction of circular polarization of the signals is reversed.

Figure 5:
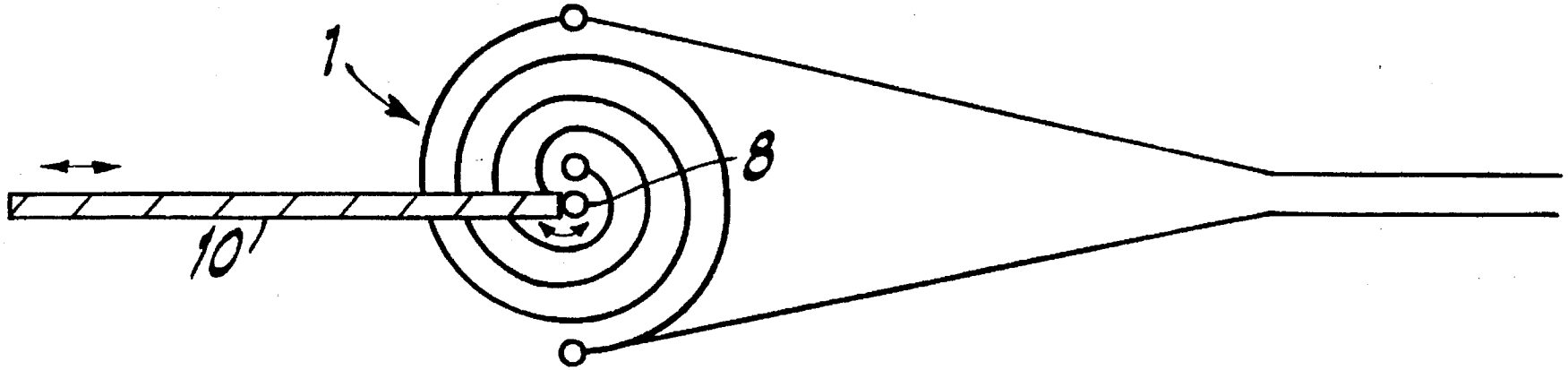
FIG. 5 shows a top-plan view of a fifth embodiment of an antenna system of the present invention.

Referring now to FIG. 5, there is shown a fifth embodiment of the present invention. This antenna system is similar to the antenna system illustrated in FIG. 4, except that the dipole antenna is replaced by a monopole antenna 10, which is connected to the spiral antenna 1 at one of the inner termination points 8 of the spiral antenna 1.

As is the case with the antenna system illustrated in FIG. 3, ease of use, simplicity of construction, and dependability are improved, while the negative effects of removing one of the elements of a dipole antenna are minimized.

Figure 6:
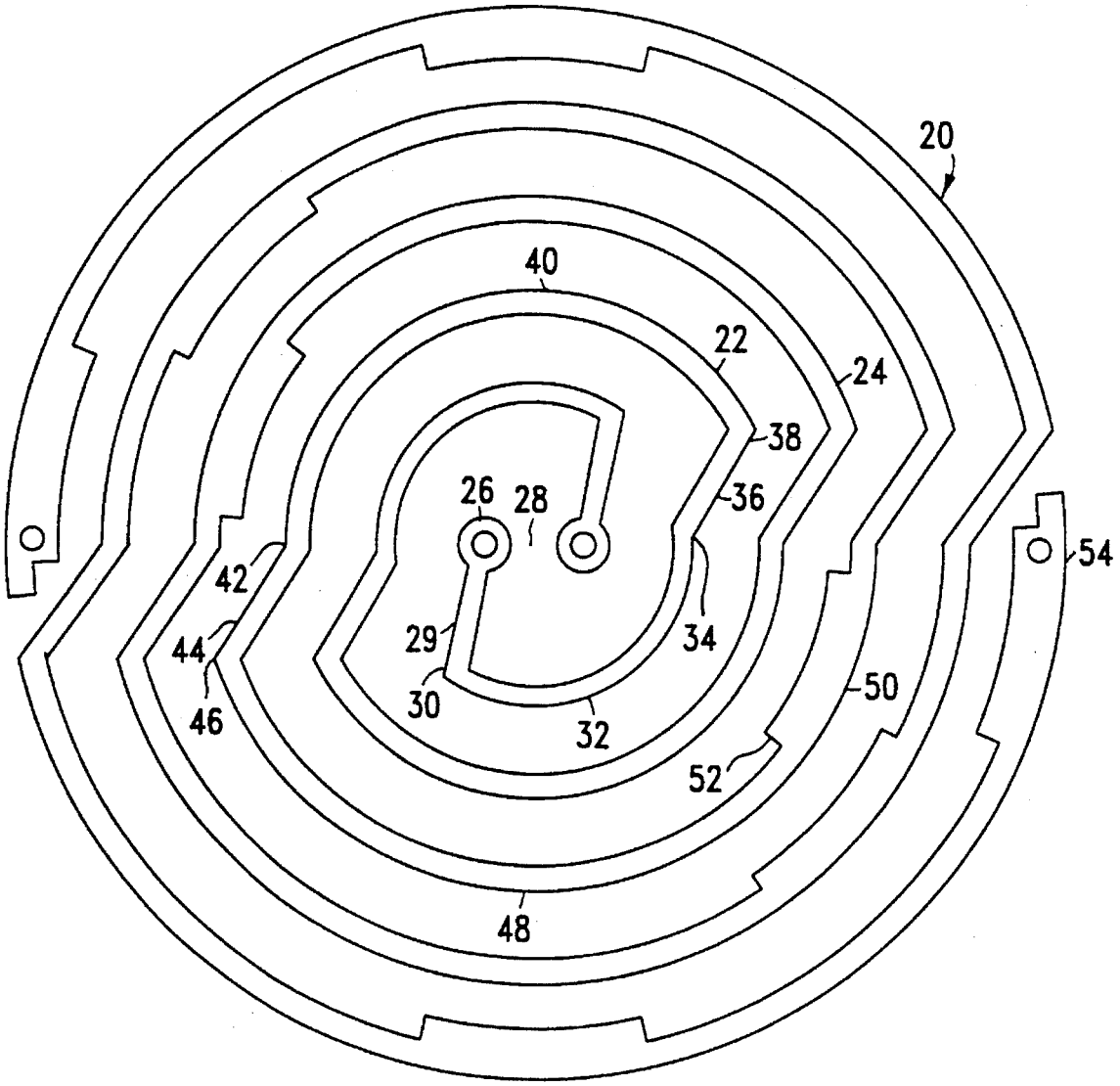
FIG. 6 shows a top-plan view of an alternative configuration of a spiral antenna that may replace the spiral antenna shown in FIGS. 1–5.

Referring now to FIG. 6, there is shown an alternative configuration of a spiral antenna 20 that may be used to replace the spiral antenna 1 in the embodiments of the antenna system according to the present invention shown in FIGS. 1–5.

Similar to spiral antenna 1, spiral antenna 20 comprises two interleaved radiating elements 22 and 24. Because the configuration of the two interleaved radiating elements 22 and 24 are identical, but are merely positioned 180° out of phase with respect to one another, the configuration of only one of the two radiating elements 22 will be described.

Element 22 extends radially outward, along path 29, from an inner termination point 26 (analogous to the inner termination points 8 of the spiral antenna 1 shown in FIGS. 1–5) in a center region 28 of the spiral antenna 20 to a first point 30 on a first radius portion 32 of the element 22. The element 22 extends along the first radius portion 32 at an approximately fixed first distance from the center region 28 of the spiral antenna 20. At a second point 34 on the first radius portion 32, the element 22 extends diagonally outward, along a path 36, to a first point 38 on a second radius portion 40 of the element 22.

The element 22 extends along the second radius portion 40 at an approximately fixed second distance (larger than the first distance) from the center region 28 of the spiral antenna 20. As can be seen in FIG. 6, at a second point 42 on the second radius portion 40, which is 180° opposed to the second point 34 on the first radius portion 32, the element 22 extends diagonally outward, along a path 44, to a first point 46 on a third radius portion 48 of the element 22. A piece 50 of the third radius portion 48 may have an inward extension 52, as shown in FIG. 6.

The element 22 continues to extend outwardly in the manner described above until an outer termination point 54 (analogous to the outer termination points 6 of the spiral antenna 1 shown in FIGS. 1–5) is reached. In the particular spiral antenna 20 shown in FIG. 6, the elements 22 and 24 contain five radius portions, although any number of such radius portions is possible.

Figure 7:
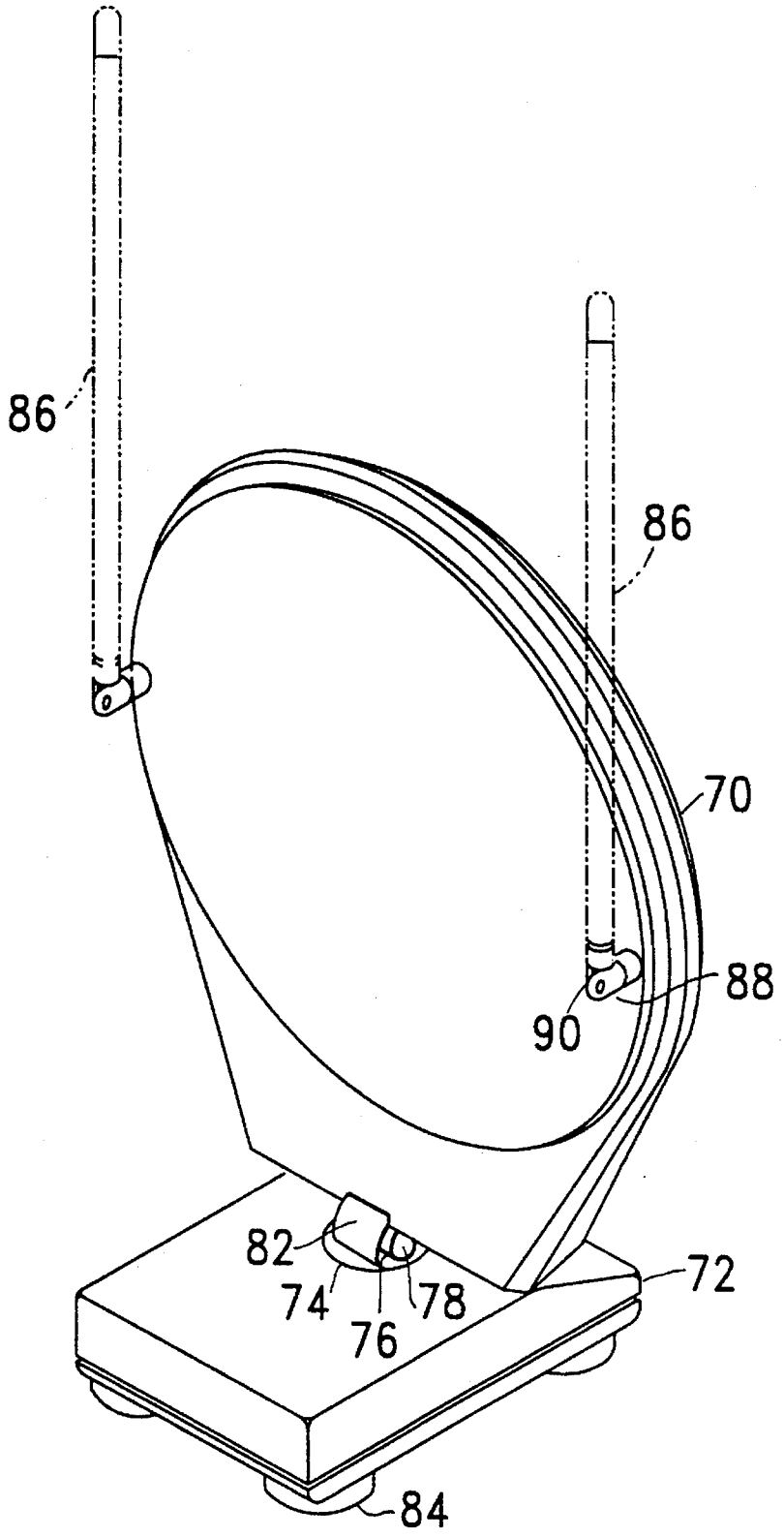
FIG. 7 shows a perspective view of a sixth embodiment of an antenna system of the present invention.
Figure 8:
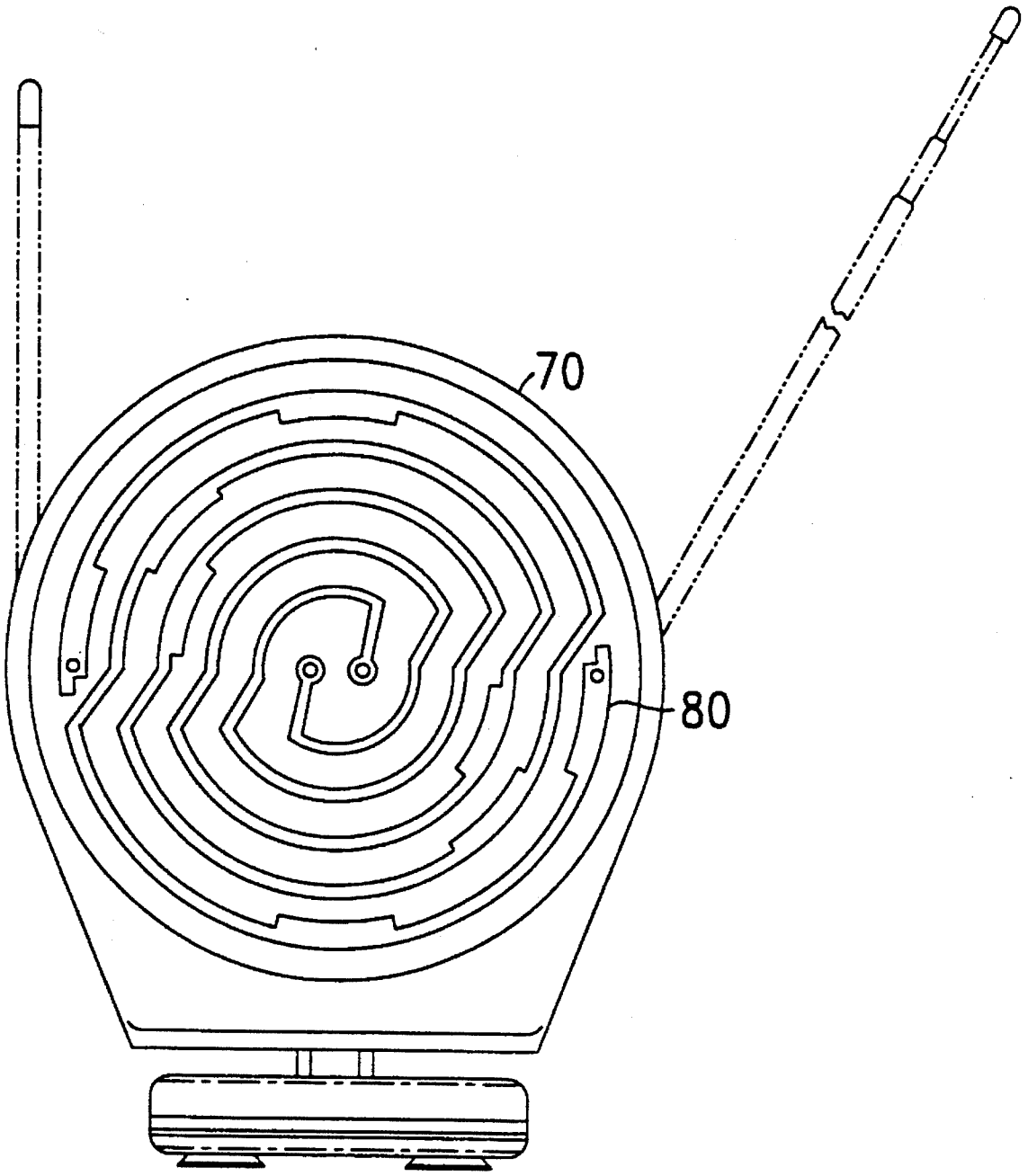
FIG. 8 shows a front sectional view of the antenna system shown in FIG. 7, illustrating the spiral antenna contained in the housing.

Referring now to FIG. 7, there is shown a perspective view of a sixth embodiment of an antenna system according to the present invention. The antenna system includes a housing 70 which surrounds, and is coupled to, a two-element spiral antenna 80, as shown in FIG. 8 (in which, the front side of the housing 70 is removed). A base 72 of the antenna system includes suction cups 84 for affixing the antenna system to a surface. The base 72 also includes a circular swivel 74 mounted for rotation within the base 72. Two projections 76 extend upwardly from the swivel 74 portion of the base 72. Each projection 76 has a bore 78 originating from its side.

An extension 82 of the housing 70 is positioned between the two projections 76. A pair of screws extend through the respective bores 78 in the projections 76 into the two sides of the extension 82 in order to support the housing 70 above the base 72.

Figure 9:
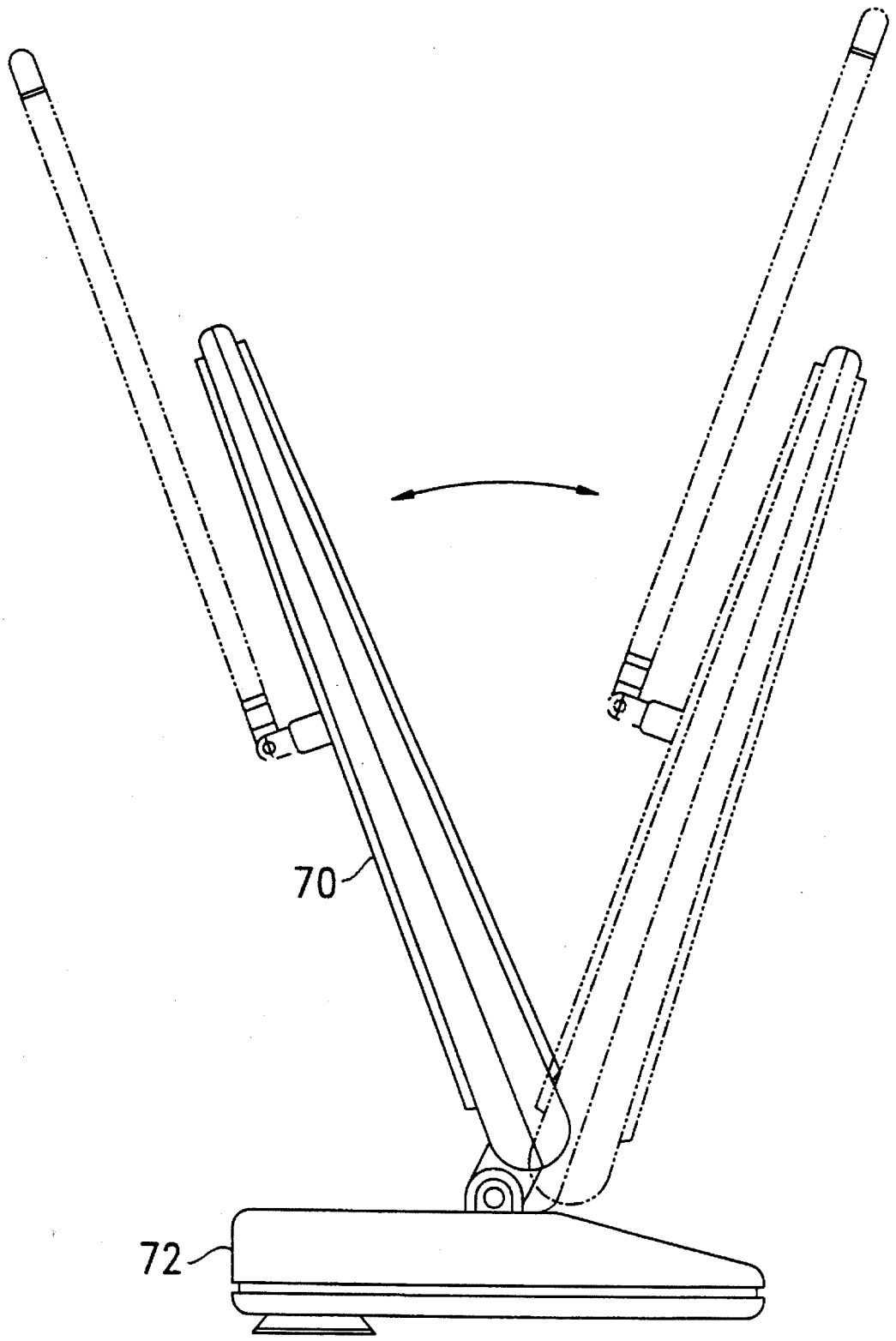
FIG. 9 illustrates the tilting motion of the housing of the antenna system shown in FIG. 7.
Figure 10:
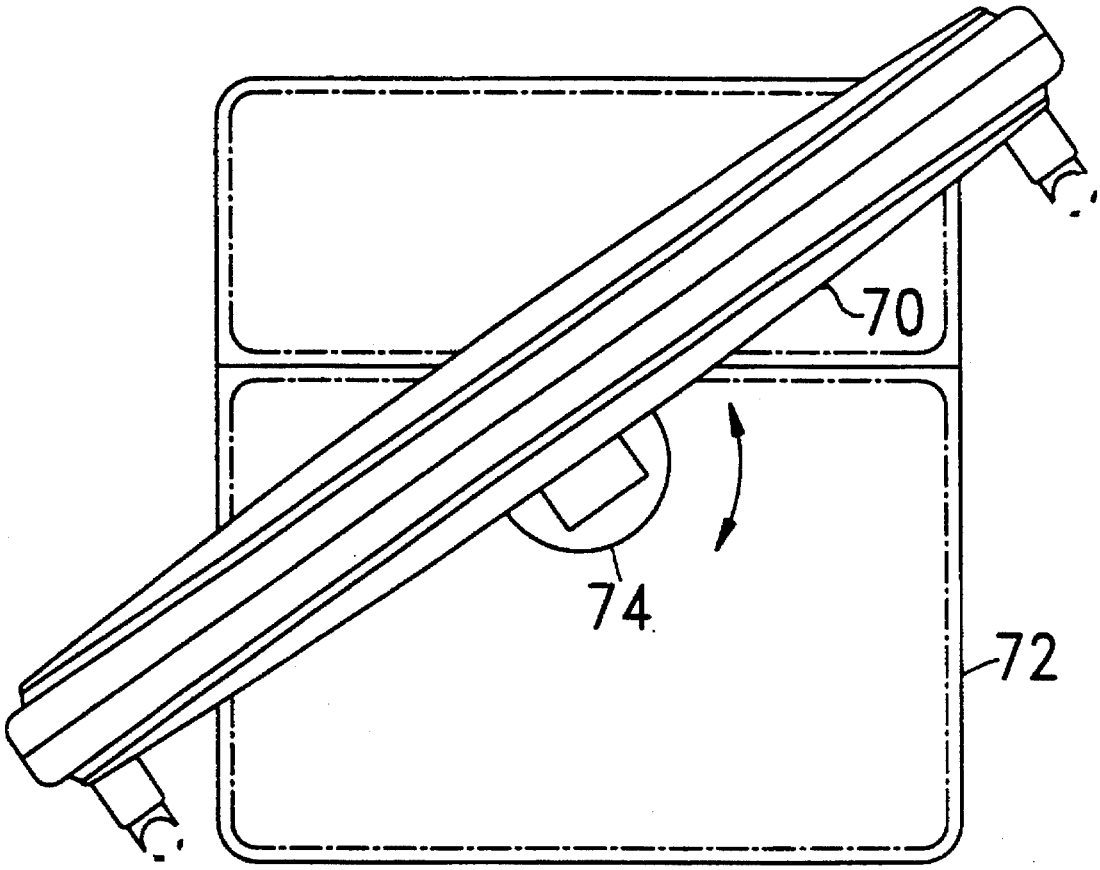
FIG. 10 illustrates the rotation of the housing of the antenna system shown in FIG. 7.

Such a coupling of the housing 70 to the base 72 allows the housing 70, and hence also the spiral antenna 80 contained within the housing 70, to tilt forward or backward with respect to the base 72, as shown in FIG. 9, and to rotate with respect to the base 72 by means of the swivel 74, as shown in FIG. 10.

Figure 11:
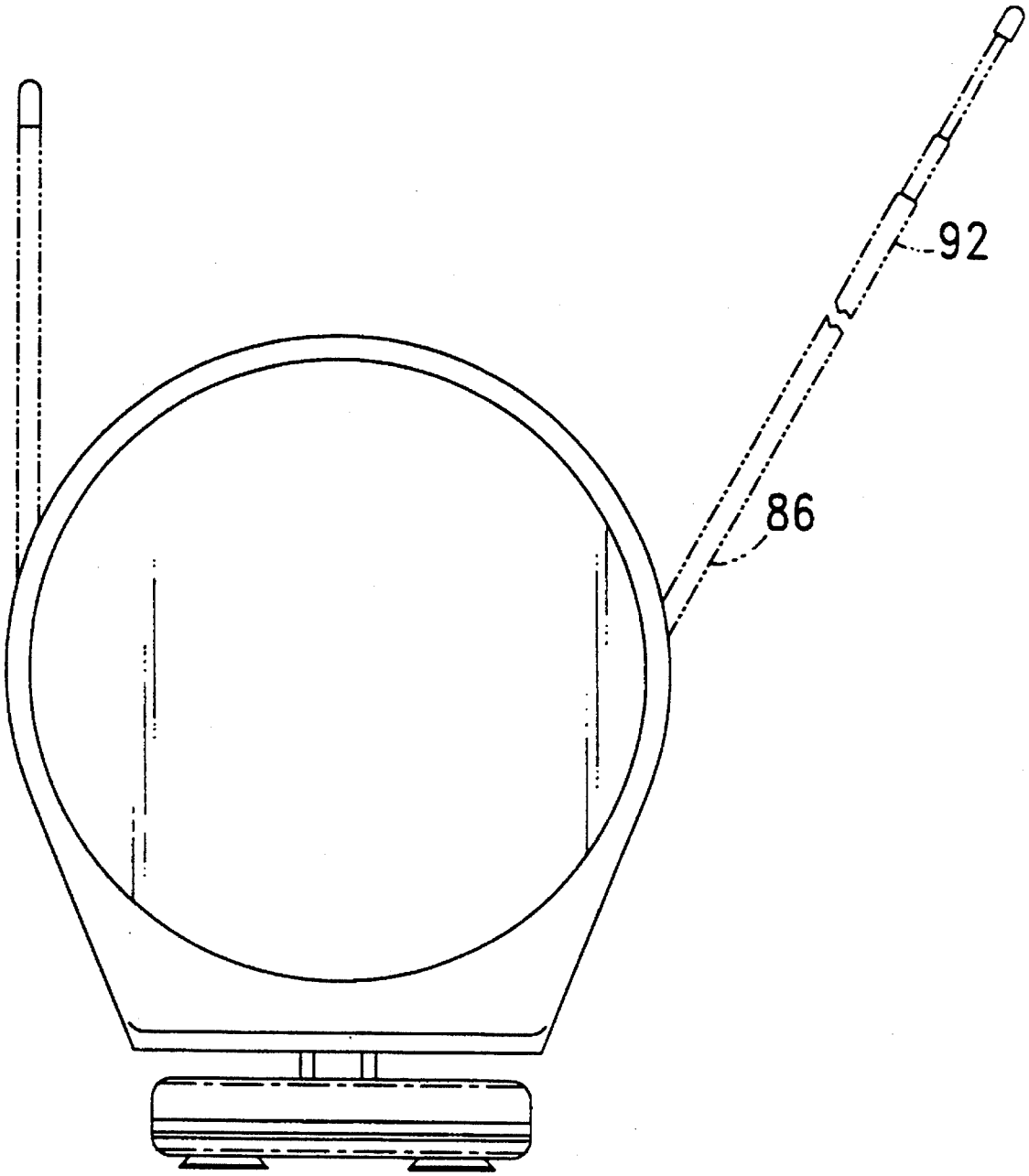
FIG. 11 illustrates the extension of a dipole element of the antenna system shown in FIG. 7.

The antenna system may, but need not, include two dipole elements 86 coupled to the housing 70, as well as to the inner or outer termination points of the spiral antenna 80 contained in the housing 70 (as set forth above), in a manner similar to the coupling between the housing 70 and the base 72. In particular, a rotatable member 88 extending from a side of the housing 70 has a slot 90 for receiving a respective dipole element 86. As such, the dipole elements 86 are free to rotate with respect to the housing 70, and hence with respect to the spiral antenna 80, as well as with respect to the base 72. The dipole elements 86 may also be shortened or lengthened at an outer portion 92 to tune to a particular frequency, as shown in FIG. 11.

Because UHF/VHF/FM signal transmitting stations are typically in different directions with respect to a receiving antenna system, rotation of the antenna(s) allows the antenna to point in the general direction of signal transmission, thus increasing received signal strength.

Tilting the spiral antenna, on the other hand, may aid in eliminating the detrimental effects of refraction, lobing, and polarization (Faraday) rotation, as will now be explained.

Refraction (i.e., bending) of electromagnetic waves around the Earth occurs because the density of the Earth's atmosphere is not uniform with respect to altitude, partially because water vapor in the atmosphere is denser at lower altitudes. Sometimes, conditions are such that waves are bent upwardly. Indeed, propagation of waves can vary widely. The ability to tilt the antenna either forward or backward may therefore help to point the antenna in the general direction of wave propagation, and thus improve received signal strength.

Lobing occurs because the Earth's surface and other reflecting surfaces can reflect waves. In particular, two or more waves can arrive at a receiving antenna at the same time via separate paths, i.e., one via a direct path and one via a reflective path. The waves can interact destructively or constructively depending upon their relative phases. If the spiral antenna is tilted upwardly, a relatively large portion of the ground-reflected waves, and thus a relatively large portion of the interference, can be avoided.

A transmitted signal may be linearly, elliptically, and/or circularly polarized, as determined by the direction of the signal's electric field vector, as discussed above. The linear polarization used in communication systems is typically either vertical or horizontal. UHF, VHF, and FM transmissions use horizontal polarization.

An electromagnetic wave propagating through an ionized medium in the presence of a magnetic field undergoes a rotation in its plane of polarization. This so-called Faraday rotation causes reception fading for linearly polarized antennas. Most antennas are linearly polarized antennas.

However, a receiving antenna, such as the tiltable spiral antenna according to the present invention, which is capable of receiving circularly polarized signals (i.e., two orthogonal polarizations of energy), receives all types of linearly polarized signals equally well, and thus fading does not occur.

What is claimed is:

1. An antenna system, comprising:

a spiral antenna including interleaved first and second spiral elements, the spiral antenna having first and second inner termination points and first and second outer termination points;

the first spiral element including a first straight line portion extending a first preselected distance outward from the first inner termination point of the spiral antenna, a first arcuate portion extending a second preselected distance from the first straight line portion;

a second straight line portion extending a third preselected distance outward from the first arcuate portion, and a second arcuate portion extending a fourth preselected distance from the second straight line portion to the first outer termination point of the spiral antenna;

the second spiral element including a third straight line portion extending a fifth preselected distance outward from the second inner termination point of the spiral antenna, a third arcuate portion extending a sixth preselected distance from the third straight line portion, a fourth straight line portion extending a seventh preselected distance outward from the third arcuate portion, and a fourth arcuate portion extending an eighth preselected distance from the fourth straight line portion to the second outer termination point of the spiral antenna;

a dipole antenna including first and second dipole elements;

a first rotatable member coupling the first dipole element to the first outer termination point of the spiral antenna, so that the first dipole element is rotatable with respect to the spiral antenna; and a second rotatable member coupling the second dipole element to the second outer termination point of the spiral antenna, so that the second dipole element is rotatable with respect to the spiral antenna.

2. The system according to claim 1, wherein the first and second spiral elements are 180° out of phase with respect to one another.

3. An antenna system, comprising:

a spiral antenna including interleaved first and second spiral elements, the spiral antenna having first and second inner termination points and first and second outer termination points;

the first spiral element including a first straight line portion extending a first preselected distance outward from the first inner termination point of the spiral antenna, a first arcuate portion extending a second preselected distance from the first straight line portion, a second straight line portion extending a third preselected distance outward from the first arcuate portion, and a second arcuate portion extending a fourth preselected distance from the second straight line portion to the first outer termination point of the spiral antenna;

the second spiral element including a third straight line portion extending a fifth preselected distance outward from the second inner termination point of the spiral antenna, a third arcuate portion extending a sixth preselected distance from the third straight line portion, a fourth straight line portion extending a seventh preselected distance outward from the third arcuate portion, and a fourth arcuate portion extending an eighth preselected distance from the fourth straight line portion to the second outer termination point of the spiral antenna;

a monopole antenna; and a rotatable member coupling the monopole antenna to the first outer termination point of the spiral antenna, so that the monopole antenna is rotatable with respect to the spiral antenna.

4. The system according to claim 3, wherein the first and second spiral elements are 180° out of phase with respect to one another.

5. An antenna system, comprising:

a spiral antenna including interleaved first and second spiral elements, the spiral antenna having first and second inner termination points and first and second outer termination points;

the first spiral element including a first straight line portion extending a first preselected distance outward from the first inner termination point of the spiral antenna, a first arcuate portion extending a second preselected distance from the first straight line portion, a second straight line portion extending a third preselected distance outward from the first arcuate portion, and a second arcuate portion extending a fourth preselected distance from the second straight line portion to the first outer termination point of the spiral antenna;

the second spiral element including a third straight line portion extending a fifth preselected distance outward from the second inner termination point of the spiral antenna, a third arcuate portion extending a sixth preselected distance from the third straight line portion, a fourth straight line portion extending a seventh preselected distance outward from the third arcuate portion, and a fourth arcuate portion extending an eighth preselected distance from the fourth straight line portion to the second outer termination point of the spiral antenna;

a dipole antenna including first and second dipole elements;

a first rotatable member coupling the first dipole element to the first inner termination point of the spiral antenna, so that the first dipole element is rotatable with respect to the spiral antenna; and a second rotatable member coupling the second dipole element to the second inner termination point of the spiral antenna, so that the second dipole element is rotatable with respect to the spiral antenna.

6. The system according to claim 5, wherein the first and second spiral elements are 180° out of phase with respect to one another.

7. An antenna system, comprising:

a spiral antenna including interleaved first and second spiral elements, the spiral antenna having first and second inner termination points and first and second outer termination points;

the first spiral element including a first straight line portion extending a first preselected distance outward from the first inner termination point of the spiral antenna, a first arcuate portion extending a second preselected distance from the first straight line portion, a second straight line portion extending a third preselected distance outward from the first arcuate portion, and a second arcuate portion extending a fourth preselected distance from the second straight line portion to the first outer termination point of the spiral antenna;

the second spiral element including a third straight line portion extending a fifth preselected distance outward from the second inner termination point of the spiral antenna, a third arcuate portion extending a sixth preselected distance from the third straight line portion, a fourth straight line portion extending a seventh preselected distance outward from the third arcuate portion, and a fourth arcuate portion extending an eighth preselected distance from the fourth straight line portion to the second outer termination point of the spiral antenna;

a monopole antenna; and a rotatable member coupling the monopole antenna to the first inner termination point of the spiral antenna, so that the monopole antenna is rotatable with respect to the spiral antenna.

8. The system according to claim 7, wherein the first and second spiral elements are 180° out of phase with respect to one another.

* * * * *